US010060238B2

(12) United States Patent
Lin et al.

(10) Patent No.: US 10,060,238 B2
(45) Date of Patent: Aug. 28, 2018

(54) METHOD FOR INTEGRATED DRILLING, SLOTTING AND OSCILLATING THERMAL INJECTION FOR COAL SEAM GAS EXTRACTION

(71) Applicant: CHINA UNIVERSITY OF MINING AND TECHNOLOGY, Xuzhou, Jiangsu (CN)

(72) Inventors: Baiquan Lin, Xuzhou Jiangsu (CN); Chang Guo, Xuzhou Jiangsu (CN); Quanle Zou, Xuzhou Jiangsu (CN); Ting Liu, Xuzhou Jiangsu (CN); Chuanjie Zhu, Xuzhou Jiangsu (CN); Jia Kong, Xuzhou Jiangsu (CN); Fazhi Yan, Xuzhou Jiangsu (CN); Hao Yao, Xuzhou Jiangsu (CN); Yidu Hong, Xuzhou Jiangsu (CN)

(73) Assignee: CHINA UNIVERSITY OF MINING AND TECHNOLOGY, Xuzhou, Jiangsu (CN)

( * ) Notice: Subject to any disclaimer, the term of this patent is extended or adjusted under 35 U.S.C. 154(b) by 128 days.

(21) Appl. No.: 15/322,457

(22) PCT Filed: Dec. 22, 2015

(86) PCT No.: PCT/CN2015/098156

§ 371 (c)(1),
(2) Date: Dec. 28, 2016

(87) PCT Pub. No.: WO2016/110186

PCT Pub. Date: Jul. 14, 2016

(65) Prior Publication Data

US 2018/0209255 A1 Jul. 26, 2018

(30) Foreign Application Priority Data

Jan. 6, 2015 (CN) ..... 2015 1 0005198

(51) Int. Cl.
*E21B 43/24* (2006.01)
*E21F 7/00* (2006.01)
(Continued)

(52) U.S. Cl.
CPC ..... *E21B 43/24* (2013.01); *E21B 7/18* (2013.01); *E21F 7/00* (2013.01); *E21B 41/0078* (2013.01)

(58) Field of Classification Search
CPC ... E21B 43/24; E21B 7/18; E21B 7/28; E21B 41/0078
See application file for complete search history.

(56) References Cited

U.S. PATENT DOCUMENTS 4,026,356 A * 5/1977 Shuck ..... E21B 7/14 166/245
8,316,966 B2 * 11/2012 Zupanick ..... B65G 5/00 166/50
(Continued)

FOREIGN PATENT DOCUMENTS

CN 101418679 1/2012
CN 102400669 4/2012
(Continued)

*Primary Examiner* — Michael R Wills, III
(74) *Attorney, Agent, or Firm* — Soroker Agmon Nordman

(57) ABSTRACT

A method for combining integrated drilling and slotting with oscillating thermal injection to enhance coalbed gas extraction, applicable to managing gas extraction from microporous, low-permeability, high-adsorption coal seam areas. A number of slots are formed within a thermal injection/extraction borehole by means of integrated drilling and slotting technology; a steam generator, is then used to three high-pressure, cyclically temperature-changing steam into said borehole; the steam passing through a spinning, oscillating-pulse jet nozzle forms an oscillating superheated steam, heating the coal body. The present method overcomes the limitations of simple permeability-increasing techniques, the slotting by means of hydraulic. pressure significantly increasing the pressure relief range of a single borehole and forming a fracture network that provides channels for passage of the superheated steam, while oscillating
(Continued)

variation in steam temperature and pressure also promote crack propagation and perforation of the coal body; the combined effect of the two enhances the efficiency of gas desorption and extraction.

4 Claims, 2 Drawing Sheets

(51) Int. Cl.
*E21B 7/18* (2006.01)
*E21B 41/00* (2006.01)

(56) References Cited

U.S. PATENT DOCUMENTS

| | | | | |
|---|---|---|---|---|
| 2008/0236817 | A1* | 10/2008 | Tillman | E21B 36/02 166/251.1 |
| 2010/0276139 | A1* | 11/2010 | Tillman | E21B 36/02 166/251.1 |
| 2017/0145794 | A1* | 5/2017 | Lin | E21B 43/24 |
| 2017/0152734 | A1* | 6/2017 | Lin | E21F 7/00 |

FOREIGN PATENT DOCUMENTS

| | | |
|---|---|---|
| CN | 101832149 | 5/2012 |
| CN | 104696003 | 6/2015 |
| RU | 2122122 | 11/1998 |
| RU | 2209315 | 7/2003 |

* cited by examiner

METHOD FOR INTEGRATED DRILLING, SLOTTING AND OSCILLATING THERMAL INJECTION FOR COAL SEAM GAS EXTRACTION

FIELD OF THE INVENTION

The present invention relates to a method for forced coal seam gas extraction by integrated drilling and slotting, and oscillating heat injection in combination, particularly applicable to gas control in micro-porous, low-permeability, high-absorptivity and high gassy coal seam areas under coal mines.

BACKGROUND OF THE INVENTION

Most coal seams in China have characteristics including high gas pressure, high gas content, low permeability, and strong absorptivity, and it is very difficult to extract gasses from the coal seams. Therefore, it is an important approach to improve permeability manually for the coal seams to improve air permeability of the coal seams and improve the gas pre-extraction rate, in order to ensure safe production in the coal mines.

At present, hydraulic measures, represented by hydraulic slotting, etc., have been widely applied in the gas control process in the coal mining fields in China, owing to their efficient pressure relief and permeability improvement effect. However, owing to the fact that the geologic conditions of the coal seams in China are complicated and the permeability of the coal seams is low, if a single hydraulic measure is used solely, because of the limited fracturing ability of water-jet cutting and high-pressure water impact, the pressure relief and permeability improvement effect are limited, the gas extraction concentration will be low, the extraction cycle will be long, and the requirement for intensive coal mining can't be met.

In addition, available research findings have demonstrated that the gas absorptivity of a coal mass decreases by about 8% whenever the temperature increases by 1° C. In recent years, many researchers have put forward heat injection-based coal seam gas extraction techniques, which increase the temperature of a coal mass and thereby promote gas desorption by injecting high-temperature stream into a coal seam. However, the heat injection form is too simple, and the engineering application of these heat injection-based coal seam gas extraction techniques is rarely seen.

CONTENTS OF THE INVENTION

Technical problem: in order to overcome the drawbacks in the prior art, the present invention provides a method for forced coal seam gas extraction by integrated drilling and slotting, and oscillating heat injection in combination, which is easy to operate, attains a remarkable permeability improvement effect, and greatly improves the gas extraction efficiency.

Technical solution: the method for forced coal seam gas extraction by integrated drilling and slotting, and oscillating heat injection in combination provided in the present invention comprises: arranging heat injection extraction borehole sites and ordinary extraction borehole sites in a coal seam in a staggered manner, drilling ordinary extraction boreholes, sealing the ordinary extraction boreholes, and inserting a main gas extraction into each of the ordinary extraction boreholes for gas extraction sequentially; then, drilling heat injection extraction boreholes by drilling at the heat injection extraction borehole sites with a drilling machine till the drill bit penetrates the roof of coal seam by lit and then withdrawing the drill stem, cutting the coal mass around each of the heat injection extraction boreholes by means of a high-pressure jet flow at an interval from inner side to outer side, to form several slots around each of the heat injection extraction boreholes, wherein, the method further comprises the following steps:

a. inserting a high-temperature resistant gas extraction pipe with multiturn through-holes arranged at an interval equal to the spacing between the slots in the wall of the high-temperature resistant gas extraction pipe into the heat injection extraction borehole, inserting a steam transmission pipeline mounted with a spinning oscillation pulsed jet sprayer on the front end of the steam transmission pipeline to the first slot at the borehole bottom through the inlet of the high-temperature resistant gas extraction pipe, connecting the spinning oscillation pulsed jet sprayer with the steam transmission pipeline via a bearing, connecting the exposed section of the steam transmission pipeline with a steam generator via a valve on the steam transmission pipeline, aligning the multiturn through-holes of the high-temperature resistant gas extraction pipe to the slots respectively, and then sealing the heat injection extraction borehole and the high-temperature resistant gas extraction pipe, and connecting the high-temperature resistant extraction pipe to a main gas extraction through a gas extraction branch pipe mounted with a valve on the gas extraction branch pipe;

b. closing the valve on the steam transmission pipeline, opening the valve on the gas extraction branch pipe, and extracting gas through the gas extraction branch pipe;

c. closing the valve on the gas extraction branch pipe, and opening the valve on the steam transmission pipeline, when the gas concentration in the heat injection extraction borehole is lower than 30%;

d. starting the steam generator and injecting super-heated steam at 100 to 500° C. into the heat injection extraction borehole through the steam transmission pipeline for 1 to 2 h, and then shutting down the steam generator and closing the valve on the steam transmission pipeline to stop the heat injection;

e. opening the valve on the gas extraction branch pipe, and extracting gas from the heat injection extraction borehole again;

f. repeating the steps c, d and e for several times, moving the steam transmission pipeline towards the hole orifice direction of the heat injection extraction borehole so that the spinning oscillation pulsed jet sprayer is moved to the next adjacent slot, when the gas concentration in the heat injection extraction borehole is always lower than 30%;

g. repeating the steps d, e and f to accomplish forced coal seam gas extraction from the heat injection extraction borehole by oscillating heat injection in combination.

The spacing between the slots is 0.5 m.

The spinning oscillation pulsed jet sprayer comprises a jet sprayer body, and a plurality of jet nozzles arranged on the sides of the jet sprayer body and connected to a center hole of the jet sprayer tangentially, wherein, the jet nozzle comprises a nozzle inlet, an oscillation cavity, and a nozzle outlet, the nozzle inlet has two stages of wall inclination transition from outside to inside the nozzle outlet has three stages of wall inclination transition from inside to outside.

The external surface of the hot steam transmission pipeline is cladded with a glass wool insulating layer.

Beneficial effects: The method disclosed in the present invention enlarges the exposed area of the coal mass and forms a fissure network by slotting, so that the scope of pressure relief and permeability improvement is enlarged for a single borehole, and the result of gas extraction from a single borehole is improved. Meanwhile, the hot steam injected into the coal mass heats up the coal mass through the fissure network, so that the gas adsorption potential in the coal mass is decreased, the gas desorption capability is improved, and thereby the gas extraction result is improved remarkably. Moreover, the super-heated steam through the spinning oscillating pulse nozzles creates oscillatory varying steam pressure, which promotes fissure propagation and perforation, and thereby the fissure network is formed more extensively. Furthermore, the pressure relief space formed by hydraulic slotting significantly increases the contact surface between the coal mass and the high-temperature stream and enlarges the scope of action of the high-temperature stream. The method disclosed in the present invention overcomes the limitation of a single permeability improvement technique, significantly enlarges the scope of pressure relief around a single borehole by means of hydraulic slotting, and forms a fissure network that provides flow channels for the super-heated steam while the oscillatory varying steam temperature and pressure promotes fissure propagation and perforation in the coal mass; under the synergetic effect of the two operations, the gas desorption efficiency is improved significantly, and efficient gas extraction is realized. The method has high practicability, is especially suitable for use in gas control in micro-porous, low-permeability, high-absorptivity and high gassy coal seam areas, and has an extensive application prospect.

Among the figures: 1—coal seam; 2—roof of coal seam; 3—heat injection extraction borehole; 4—ordinary extraction borehole; 5—slot; 6—spinning oscillation pulsed jet sprayer; 6-1—nozzle inlet; 6-2—oscillation cavity; 6-3—nozzle outlet; 7—steam generator; 8—hot steam transmission pipeline; 9—valve on steam transmission pipeline; 10—high-temperature resistant gas extraction pipe; 11—gas extraction branch pipe; 12—valve on gas extraction branch pipe; 13—bearing; 14—main gas extraction.

DETAILED DESCRIPTION OF THE EMBODIMENTS

Hereunder the present invention will be detailed in an embodiment with reference to the accompanying drawings.

Figure 1:
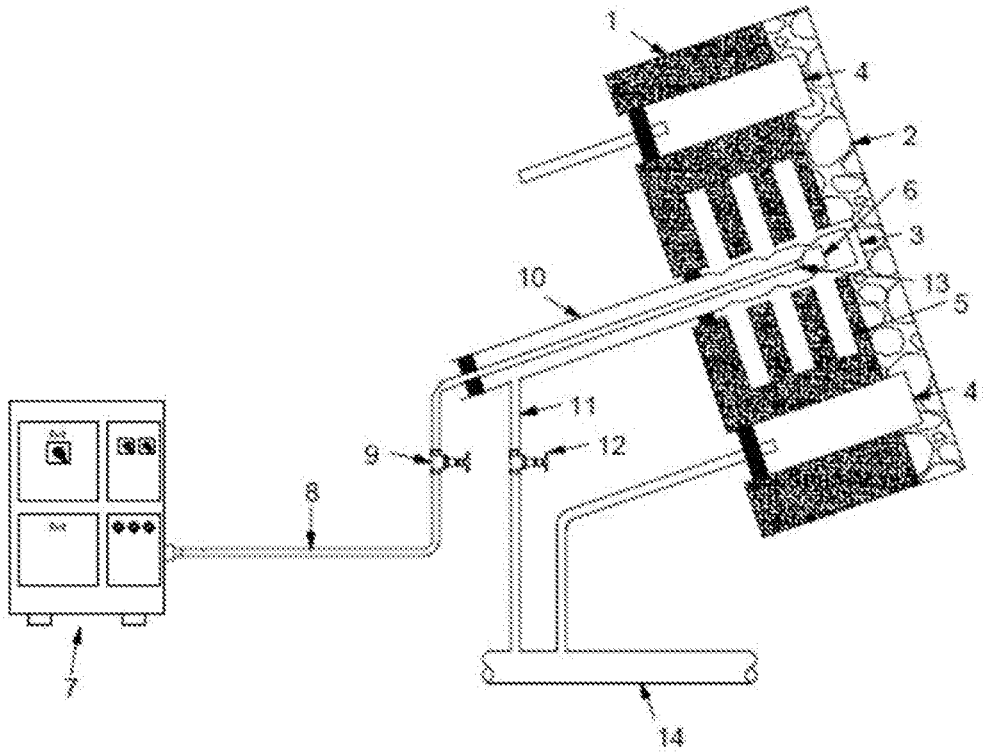
FIG. 1 is a schematic diagram of the method according to the present invention.
Figure 2:
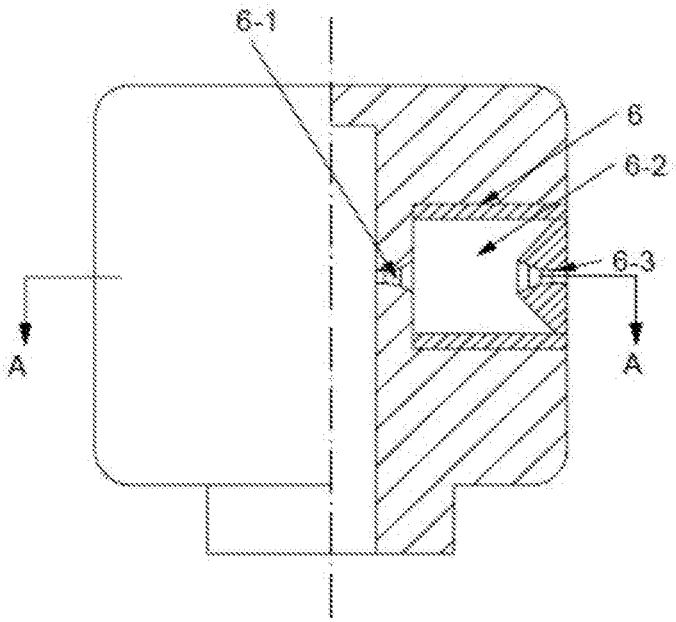
FIG. 2 is a schematic structural diagram of the spinning oscillation pulsed jet sprayer.
Figure 3:
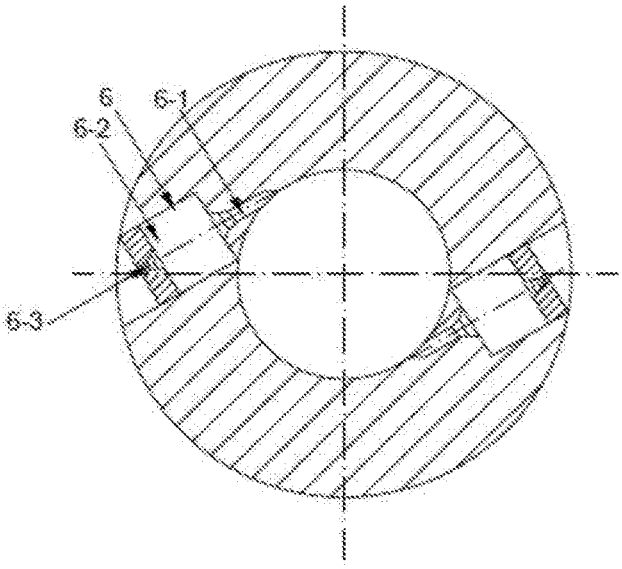
FIG. 3 is a sectional view in A-A direction of the structure shown in FIG. 2.
Figure 4:
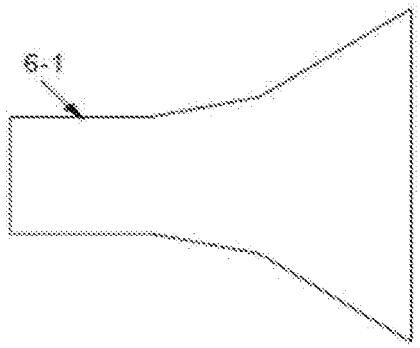
FIG. 4 is a schematic structural diagram of the nozzle inlet of the spinning oscillation pulsed jet sprayer.
Figure 5:
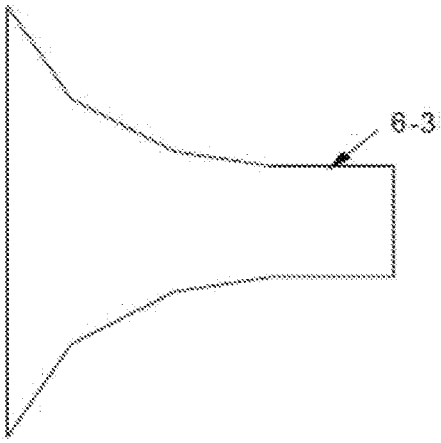
FIG. 5 is a schematic structural diagram of the nozzle outlet of the spinning oscillation pulsed jet sprayer.

As shown in FIG. 1, the method for forced coal seam gas extraction by integrated drilling and slotting, and oscillating heat injection in combination provided in the present invention comprises the following steps:

a. arranging sites of heat injection extraction boreholes 3 and sites of ordinary extraction boreholes 4 in a coal seam 1 in a staggered manner, drilling ordinary extraction boreholes 4, sealing the ordinary extraction boreholes 4, and connecting the ordinary extraction boreholes 4 to a main gas extraction 14 for gas extraction; then, drilling heat injection extraction boreholes 3 by drilling at the sites of heat injection extraction boreholes 3 with a drilling machine till the drill bit penetrates the roof 2 of coal seam by 1 m and then withdrawing the drill stem, cutting the coal mass around each of the heat injection extraction boreholes 3 by means of a high-pressure jet flow at an interval from inner side to outer side, to form several slots 5 at 0.5 m interval around each of the heat injection extraction boreholes 3;

b. inserting a high-temperature resistant gas extraction pipe 10 with multiturn through-holes arranged at an interval equal to the spacing between the slots 5 in the wall of the high-temperature resistant gas extraction pipe 10 into the heat injection extraction borehole 3, inserting a steam transmission pipeline 8 mounted with a spinning oscillation pulsed jet sprayer 6 on the front end of the steam transmission pipeline 8 through the inlet of the high-temperature resistant gas extraction pipe 10 to the first slot 5 at the borehole bottom, connecting the spinning oscillation pulsed jet sprayer 6 with the steam transmission pipeline 8 via a hearing 13, connecting the exposed section of the steam transmission pipeline 8 with a steam generator 7 via a valve 9 on the steam transmission pipeline 8, aligning the multiturn through-holes of the high-temperature resistant gas extraction pipe 10 to the slots 5 respectively, and then sealing the heat injection extraction borehole 3 and the high-temperature resistant gas extraction pipe 10, and connecting the high-temperature resistant extraction pipe 10 to a main gas extraction 14 through a gas extraction branch pipe 11 mounted with a valve 12 on the gas extraction branch pipe 11; as shown in FIG. 2, the spinning oscillation pulsed jet sprayer 6 comprises a jet sprayer body, and two jet nozzles arranged on the sides of the jet sprayer body and connected to a center hole of the jet sprayer tangentially, as shown in FIG. 3, wherein, the jet nozzle comprises a nozzle inlet 6-1, an oscillation cavity 6-2, and a nozzle outlet 6-3, the nozzle inlet 6-1 has two stages of wall inclination transition from outside to inside, as shown in FIG. 4; the nozzle outlet 6-3 has three stages of wall inclination transition from inside to outside, as shown in FIG. 5; the external surface of the hot steam transmission pipeline 8 is cladded with a glass wool insulating layer; the through-holes arranged on the high-temperature resistant gas extraction pipe 10 corresponding to the slots 5 are in 0.003 m diameter;

c. closing the valve 9 on the steam transmission pipeline, opening the valve 12 on the gas extraction branch pipe, and extracting gas through the gas extraction branch pipe 11;

d. closing the valve 12 on the gas extraction branch pipe, and opening the valve 9 on the steam transmission pipeline, when the gas concentration in the heat injection extraction borehole 3 is lower than 30%;

e. starting the steam generator 7 to output steam at 100 to 500° C. temperature regulated cyclically; injecting super-heated steam at 100 to 500° C. via the spinning oscillation pulsed jet sprayer 6 into the heat injection extraction borehole 3 by steam transmission pipeline 8, wherein, passing the high-temperature and high-pressure air through the spinning oscillation pulsed jet sprayer 6 to achieve the periodic pulsation of steam pressure, the steam stream erupted from nozzle outlet 6-3 creates a counterforce against the spinning oscillation pulsed jet sprayer 6, and the spinning oscillation pulsed jet sprayer 6 spins automatically under the tangential component of the counterforce as it jets the seam stream; shutting down the steam generator 7 and closing the value 9 on the steam transmission pipeline to stop the heat injection, after the heat injection lasts for 1 to 2 h; the spinning oscillation pulsed jet sprayer 6 is connected with the steam transmission pipeline 8 via the bearing 13, with a waterproof seal ring mounted between them;

f. opening the valve 12 on the gas extraction branch pipe, and extracting gas from the heat injection extraction borehole 3 again;

g. repeating the steps d, e and c for several times, moving the steam transmission pipeline 8 towards the hole orifice direction of the heat injection extraction borehole 3 so that the spinning oscillation pulsed jet sprayer 6 is moved to the next adjacent slot 5, when the gas concentration in the heat injection extraction borehole 3 is always lower than 30%;

h. repeating the steps e, f and g to accomplish forced coal seam gas extraction from the heat injection extraction borehole 3 by oscillating heat injection in combination.

The invention claimed is:

1. A method for forced coal seam gas extraction by integrated drilling and slotting, and oscillating heat injection in combination, comprising: arranging sites of heat injection extraction borehole (3) and sites of ordinary extraction borehole (4) in a coal seam (1) in a staggered manner, drilling ordinary extraction boreholes (4), sealing the ordinary extraction boreholes (4), and inserting a main gas extraction (14) into each of the ordinary extraction boreholes (4) for gas extraction sequentially; then, drilling heat injection extraction boreholes (3) by drilling at the sites of heat injection extraction borehole (3) with a drilling machine till the drill bit penetrates the roof (2) of coal seam by 1 m and then withdrawing the drill stem, cutting the coal mass around each of the heat injection extraction boreholes (3) by means of a high-pressure jet flow at an interval from inner side to outer side, to form several slots (5) around each of the heat injection extraction boreholes (3), wherein, the method further comprises the following steps:

a. inserting a high-temperature resistant gas extraction pipe (10) with multiturn through-holes arranged at an interval equal to the spacing between the slots (5) in the wall of the high-temperature resistant gas extraction pipe (10) into the heat injection extraction borehole (3), inserting a steam transmission pipeline (8) mounted with a spinning oscillation pulsed jet sprayer (6) on the front end of the steam transmission pipeline (8) through the inlet of the high-temperature resistant gas extraction pipe (10) to the first slot (5) at the borehole bottom, connecting the spinning oscillation pulsed jet sprayer (6) with the steam transmission pipeline (8) via a bearing (13), connecting the exposed section of the steam transmission pipeline (8) with a steam generator (7) via a valve (9) on the steam transmission pipeline (8), aligning the multiturn through-holes of the high-temperature resistant gas extraction pipe (10) to the slots (5) respectively, and then sealing the heat injection extraction borehole (3) and the high-temperature resistant gas extraction pipe (10), and connecting the high-temperature resistant extraction pipe (10) to a main gas extraction (14) through a gas extraction branch pipe (11) mounted with a valve (12) on the gas extraction branch pipe (11);

b. closing the valve (9) on the steam transmission pipeline, opening the valve (12) on the gas extraction branch pipe, and extracting gas through the gas extraction branch pipe (11);

c. closing the valve (12) on the gas extraction branch pipe, and opening the valve (9) on the steam transmission pipeline, when the gas concentration in the heat injection extraction borehole (3) is lower than 30%;

d. starting the steam generator (7) and injecting superheated steam at 100 to 500° C.: into the heat injection extraction borehole (3) through the steam transmission pipeline (8) for 1 to 2 h, and then shutting down the steam generator (7) and closing the valve (9) on the steam transmission pipeline to stop the heat injection;

e. opening the valve (12) on the gas extraction branch pipe, and extracting gas from the heat injection extraction borehole (3) again;

repeating the steps c, d and e for several times, moving the steam transmission pipeline (8) towards the hole orifice direction of the heat injection extraction borehole (3) so that the spinning oscillation pulsed jet sprayer (6) is moved to the next adjacent slot (5), when the gas concentration in the heat injection extraction borehole (3) is always lower than 30%;

g. repeating the steps d, e and f, to accomplish forced coal seam gas extraction from the heat injection extraction borehole (3) by oscillating heat injection in combination.

2. The method for forced coal seam gas extraction by integrated drilling and slotting, and oscillating heat injection in combination according to claim 1, wherein, the spacing between the slots (2) is 0.5 m.

3. The method for forced coal seam gas extraction by integrated drilling and slotting, and oscillating heat injection in combination according to claim 1, wherein, the spinning oscillation pulsed jet sprayer (6) comprises a jet sprayer body, and a plurality of jet nozzles arranged on the sides of the jet sprayer body and connected to a center hole of the jet sprayer tangentially, wherein, the jet nozzle comprises a nozzle inlet (6-1), an oscillation cavity (6-2), and a nozzle outlet (6-3), the nozzle inlet (6-1) has two stages of wall inclination transition from outside to inside; the nozzle outlet (6-3) has three stages of wall inclination transition from inside to outside.

4. The method for forced coal seam gas extraction by integrated drilling and slotting, and oscillating heat injection in combination according to claim 1, wherein, the external surface of the hot steam transmission pipeline (8) is cladded with a glass wool insulating layer.

* * * * *